United States Patent [19]

Kreibaum

[11] 4,306,596

[45] Dec. 22, 1981

[54] DEVICE FOR PROCESSING ROUND LUMBER SECTIONS

[76] Inventor: Otto Kreibaum, Ortsteil Thuste, 3216 Salzhemmendorf 7, Fed. Rep. of Germany

[21] Appl. No.: 150,305

[22] Filed: May 16, 1980

[30] Foreign Application Priority Data

May 26, 1979 [DE] Fed. Rep. of Germany ..... 2921458

[51] Int. Cl.[3] ..... B27C 1/08; B27C 9/04

[52] U.S. Cl. ..... 144/3 R; 144/245 R; 144/246 C; 144/326 R; 198/486; 414/745; 83/437

[58] Field of Search ..... 196/486, 624, 435; 144/2 R, 3 R, 37, 39, 41, 208 R, 134 R, 208 E, 242 R, 245 R, 246 R, 246 C, 246 D, 246 F, 312, 326 R; 414/745; 83/409, 437, 425, 425.1

[56] References Cited

U.S. PATENT DOCUMENTS

| | | | |
|---|---|---|---|
| 2,780,253 | 2/1957 | Joa | 144/246 C |
| 3,971,423 | 7/1976 | Miller | 144/246 C |
| 4,147,259 | 4/1979 | Nilsson | 144/312 |
| 4,152,960 | 5/1979 | Detjen | 144/39 |

*Primary Examiner*—W. D. Bray

*Attorney, Agent, or Firm*—Prutzman, Kalb, Chilton & Alix

[57] ABSTRACT

Log processing apparatus having a cutting station with guide surface cutting means for cutting exterior guide surfaces on a log, stationary guide means forward of the guide surface cutting means and engageable with the cut guide surfaces of a log for guiding the log along a process centerline of the apparatus, and entrance and exit transport mechanisms for transporting a log along the process centerline through and beyond the cutting station, the entrance transport mechanism having separate coaxial forward and rear log clamping means for feeding a log to and through the cutting station and stationary guide means to the exit transport mechanism.

6 Claims, 5 Drawing Figures

DEVICE FOR PROCESSING ROUND LUMBER SECTIONS

DESCRIPTION

1. Technical Field

The present invention relates generally to log processing mills of the type having a guide surface cutting station for cutting guide surfaces on round lumber logs, peeled logs or the like for subsequent use in an automatic sawmill for guiding the logs and the present invention relates more particularly to a new and improved log processing mill which provides for accurately cutting exactly linear guide surfaces on the logs to ensure that the logs are thereafter accurately guided through a sawmill for being cut straight with a rectilinear profile and with minimum waste.

2. Background and Disclosure of The Invention

In order to automatically convey round lumber sections or logs through a sawmill for automatically cutting them into cut lumber with a saw which is preadjusted according to the cross section of the round lumber, the round lumber sections are first profiled by cutting exterior guide surfaces on them for use in accurately guiding them through the sawmill. For example, in Federal Republic of Germany published Patent Application DE-OS 27 08 518, exterior guide surfaces are cut on round lumber sections or logs to facilitate feeding and guiding the round lumber sections for cutting them into a cylindrical shape. However, the devices used to date for producing guide surfaces have the disadvantage in not ensuring accurate rectilinear processing of the round lumber notwithstanding variations in their shape or deviations from their usual slight taper and with the result that inferior lumber and/or rejects are produced.

It is therefore a principal object of the present invention to provide a new and improved device for accurately cutting exterior guide surfaces on round lumber sections or logs to enable them to be accurately fed through an automatic sawmill for automatically cutting the processed round lumber sections with increased accuracy and with minimum waste.

Other objects will be in part obvious and in part pointed out more in detail hereinafter.

A better understanding of the invention will be obtained from the following detailed description and the accompanying drawings of illustrative applications of the invention.

BEST MODE FOR CARRYING OUT THE INVENTION

Figure 1:
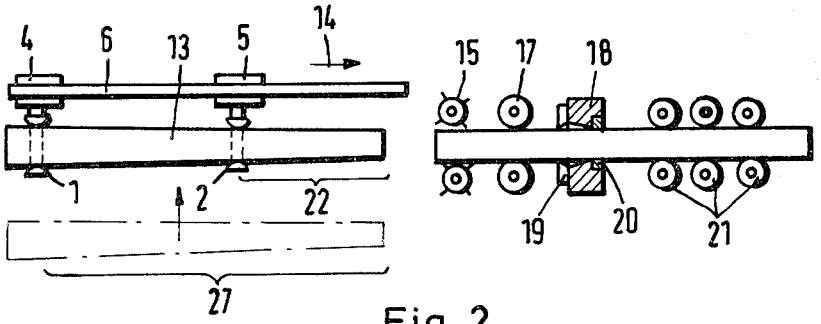
FIGS. 1, 2, and 3 are diagrammatic views, partly in section, of a log processing mill incorporating an embodiment of the present invention and showing the mill in three successive operating phases thereof.

Referring now to the drawing in detail, a log processing mill incorporating an embodiment of the present invention is diagrammatically shown employed for individually feeding elongated round lumbers logs, peeled logs or the like 13 of the same predetermined length along a process centerline from a rear loading station shown in FIG. 1 forwardly through a first guide surface cutting station having a pair of diametrically opposed rotary guide surface cutters 15 and then through a second succeeding guide surface cutting station having a rotary cutting head 18.

Figure 4:
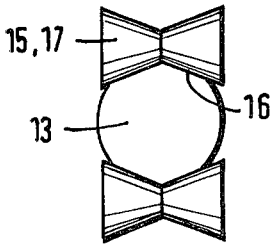
FIG. 4 is a generally diagrammatic transverse view of the log processing mill showing the shape of a pair of guide surface cutters and succeeding guide rolls of the mill.

Referring to FIG. 4, each rotary guide surface cutter 15 has a pair of opposed generally conical cutter sections providing an inverted V-shaped cutting edge and such that the two diametrically opposed rotary cutters 15 provide for cutting a pair of diametrically opposed, exterior V-shaped guide surfaces 16 along the round lumber log or section 13. The rotary cutters 15 are laterally adjustable so that even with a tapered round lumber log or section 13 as shown in FIG. 1, the guide surface cutters 15 are adjusted to provide for cutting guide surfaces 16 having a fixed diametral spacing and a cross section profile deviating from a circular cross section along the entire length of the log 13. Also, the guide surface cutters 15 are adjusted so that the cutters 15 are equally radially spaced from the process centerline of the mill.

A pair of diametrically opposed guide rolls 17 are provided between the first and second guide surface cutting stations. The guide rolls 17 have an inverted V-shape conforming to the V-shaped guide surfaces 16. The guide rolls 17 are laterally adjusted in accordance with the lateral position of the guide surface cutters 15 to firmly engage the guide surfaces 16 and thereby hold the round lumber segment against rotation and also coaxial with the process centerline of the mill.

The rotary cutting head 18 is rotatable about the process centerline of the mill and comprises a ring with a plurality of angularly spaced cutters or knives 19 for cutting the lumber segment 13 into a cylindrical shape and thereby providing a cylindrical guide surface. The cutters 19 are radially adjusted to establish their cutting diameter, and therefore the diameter of the cylindrical product emerging from the mill is in accordance with the minimum diameter of the entrance log 13. Also, the rotary cutting head 18 has a guide ring 20 with an inner cylindrical surface with a diameter slightly greater, by a fraction of a millimeter, than the cutting diameter so that the guide ring 20 is effective in guiding the cylindrical product coaxially along the process centerline of the mill.

Downstream or forward of the rotary cutting head 18, there is provided an exit transport mechanism having one or more pairs (three being shown) of diametrically opposed guide rolls 21 which are suitably driven and which may also have for example a circular concave profile with a radius equal to or greater than the emerging cylindrical log product to assist in feeding the log through the mill. The guide rolls 21 are suitably laterally adjusted in accordance with the diameter of the cylindrical product to firmly guide the cylindrical product emerging from the cutting head 18 along the mill centerline as well as to feed the milled product forwardly from the cutting head 18.

A rear or entrance stock transport mechanism is longitudinally shiftable for feeding (at a uniform speed the same as the uniform speed provided by the exit transport mechanism) each log 13 from a rear loading station (where the forward end of the log 13 is positioned rearwardly of the surface guide cutters 15) forwardly along the mill centerline through the pair of surface guide cutters 15, guide rolls 17 and rotary cutting head 18. The log length and position of the log 13 at the loading station are predetermined in accordance with the dimensions of the installation and also to provide sufficient distance between the log and the cutters 18 to satisfy appropriate safety and structural considerations.

The rear stock transport mechanism comprises a pair of independently operable clamping mechanisms 1, 2 which have respective support carriages 4, 5 mounted on a guide rail 6 extending parallel to the mill centerline for feeding the clamps 1, 2 back and forth between their rear loading positions and their forward terminal positions. A suitable feed mechanism (not shown) is connected to each of the support carriages 4, 5 for shifting them forwardly from their fully retracted loading position shown in FIG. 1 where the clamps 1, 2 are spaced apart for receiving and clamping a log 13 of the fixed predetermined length.

Figure 5:
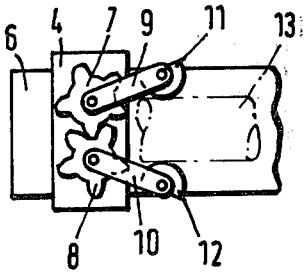
FIG. 5 is a generally diagrammatic side view, partly broken away, of a clamping mechanism of the mill.

The clamps 1, 2 are designed, for example as shown in FIG. 5, to have preferably only two clamping jaws 11, 12 which can be laterally withdrawn to enable the round lumber log 13 to be loaded sidewise into position between the open jaws 11, 12 of both clamps 1, 2 and which can then be closed to secure the log 13 in place. The jaws 11, 12 of each clamping mechanism 1, 2 are interconnected, for example by mounting the jaws 11, 12 on levers 9, 10 having interengaging gears 7, 8 so that the jaws 11, 12 open and close together always equidistant from the mill centerline. Accordingly, the clamps 1, 2 provide automatic centering for clamping a log 13 into position with its axis on the process centerline of the mill. In contrast prior mill clamping devices employ stationary jaws which do not necessarily position the log axis coaxially with the mill axis but in accordance with circumferential gripping points used with the stationary jaws. Such prior mill clamping devices erroneously assumed that the convex log surface line between the two circumferential gripping points did not vary and so that relatively minor deviations from that assumption resulted in the production of rejects.

Figure 2:
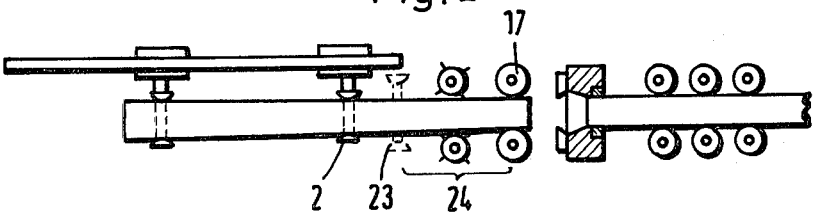
Figure 3:
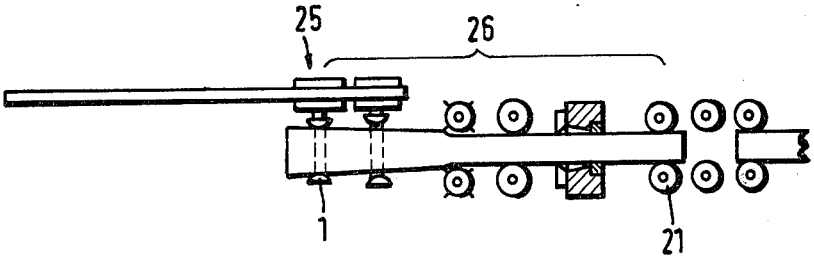

In the fully retracted loading position of the rear stock transport mechanism, the rear clamp 1 is axially positioned to clamp the rear end of the log 13 and the forward clamp 2 is axially positioned substantially forwardly of the rear clamp but also substantially rearwardly of the forward end of the log 13 and for example slightly forward of the midpoint of the log 13 as shown in FIG. 1. More particularly, the forward clamp 2 is positioned so that the length 22 of stock projecting forwardly from the clamp is greater than the distance 24 between a forward terminal or limit position of clamp 2 (shown in broken lines in FIG. 2 and in full lines in FIG. 3 and which is adjacent to but rearwardly of the rotary guide surface cutters 15) and the guide rolls 17. As such, the forward clamp 2 and the rear clamp 1 together are effective (during the linear cutting stroke of travel of the forward clamp 2 from commencement of cutting by the cutters 15 to when the clamp 2 reaches its forward terminal position) in feeding and guiding the stock coaxially along the process centerline of the mill and until after the guide rolls 17 are fully effective in guiding the stock.

The forward clamp 2 is then opened and left in its forward terminal position while the rear clamp 1 continues to feed the stock forward. During such continuing stock feed, the rear clamp 1 cooperates with the guide rolls 17 to accurately guide the stock coaxially along the process centerline of the mill. The rear clamp 1 is positioned rearwardly of the forward end of the stock by a distance 27 (FIG. 1) which is greater than the distance 26 between the forward terminal position of the rear clamp 1 (shown in FIG. 3) and the rear station feed rolls 21 of the exit transport mechanism. As such, the rear clamp 1 is effective (during its linear cutting stroke of travel from commencement of cutting by the cutters 15 to when the clamp 1 reaches its forward terminal position adjacent to and rearwardly of the forward terminal position of the forward clamp 2) in feeding and guiding the stock coaxially along the process centerline of the mill. Also, the forward cylindrical end of the partly processed log 13 is fed between the rear pair of rolls 21 of the exit transport mechanism before the rear clamp 1 reaches its forward terminal position and is opened to release the stock entirely from the entrance transport mechanism. Thereafter, the exit transport feed rolls 21 complete the transport of the log 13 through the mill and cooperate first with both the guide rolls 17 and guide ring 21 and then with the guide ring 21 alone to ensure that the log 13 remains coaxial with the process centerline of the mill.

As will be apparent to persons skilled in the art, various modifications, adaptations and variations of the foregoing specific disclosure can be made without departing from the teachings of the present invention.

I claim:

1. In a log processing mill for successively processing logs of the same fixed predetermined length and having a cutting station with guide surface cutting means for cutting exterior guide surfaces on a log as it is fed forwardly along a process centerline through the cutting station, fixed station guide means forward of the guide surface cutting means and engageable with the guide surfaces in a said log cut thereby for guiding the log along the process centerline, and entrance and exit transport mechanisms rearwardly of the cutting station and forwardly of the guide means respectively for longitudinally forwardly transporting a log of said fixed predetermined length along the process centerline from a retracted position rearwardly of the cutting station through and beyond the cutting station and guide means, the improvement wherein the entrance transport mechanism comprises at least two successive coaxial forward and rear clamp means independently operable for clamping and unclamping a log of said fixed predetermined length coaxial with the process centerline, and means for supporting said two clamp means for being independently shifted parallel to the process centerline from respective cut starting positions thereof to forward limit positions thereof rearwardly of the guide surface cutting means for feeding a said log of said fixed predetermined length clamped initially by both clamp means and then only by said rear clamp means along the process centerline and partly through the cutting station guide means and the exit transport means, wherein the guide means is spaced from the forward limit position of the forward clamp means a distance less than the distance between the cut starting position of the forward clamp means and the guide surface cutting means so that both of said clamp means are operable to feed a said log of said fixed predetermined length partly through the fixed station guide means, and wherein the exit transport means comprises fixed station transport means engageable with a processed log for guiding and transporting it along the process centerline and spaced from the forward limit position of the rear clamp means a distance less than the distance between the cut starting position of the rear clamp means and the guide surface cutting means so that the rear clamp means is operable to feed a said log of fixed predetermined length partly through the exit transport means.

2. A log processing mill according to claim 1 wherein said two clamp means are operable for automatically clamping a said log substantially centered on the process centerline of the mill.

3. A log processing mill according to claim 1 or 2 wherein each of said two clamp means comprises at least two clamping jaws and means interconnecting the jaws for joint clamping engagement with the log equidistant from the process centerline.

4. A log processing mill according to claims 1 or 2 wherein the guide surface cutting means is operable for cutting guide surfaces which in cross section deviate from a circular cross section, and wherein the mill further comprises second cutter means between the guide means and the forward transport means for cutting a said log fed along the process centerline into a cylindrical shape.

5. A log processing mill according to claim 4 wherein the second cutter means comprises a forward guide ring coaxial with the process centerline and having an internal diameter approximately equal to the cut diameter of the processed cylindrical log for guiding the log coaxially along the process centerline.

6. A log processing mill according to claim 4 wherein the forward transport means comprises concave drive rolls for guiding and transporting the processed cylindrical log coaxially along the process centerline.

* * * * *